US012122566B2

(12) United States Patent
Lutzenberger

(10) Patent No.: US 12,122,566 B2
(45) Date of Patent: Oct. 22, 2024

(54) FLATTENABLE VOLUME-OPTIMIZED CONTAINER

(71) Applicant: TRICOR Packaging & Logistics AG, Bad Woerishofen (DE)

(72) Inventor: Georg Lutzenberger, Eppishausen (DE)

( * ) Notice: Subject to any disclaimer, the term of this patent is extended or adjusted under 35 U.S.C. 154(b) by 0 days.

(21) Appl. No.: 17/642,841

(22) PCT Filed: Jun. 26, 2020

(86) PCT No.: PCT/EP2020/000119
§ 371 (c)(1),
(2) Date: Mar. 14, 2022

(87) PCT Pub. No.: WO2020/259865
PCT Pub. Date: Dec. 30, 2020

(65) Prior Publication Data

US 2024/0017875 A1 Jan. 18, 2024

(30) Foreign Application Priority Data

Jun. 28, 2019 (DE) ..... 10 2019 004 490.8

(51) Int. Cl.
*B65D 5/36* (2006.01)
*B65D 5/02* (2006.01)
*B65D 5/12* (2006.01)

(52) U.S. Cl.
CPC ..... *B65D 5/36* (2013.01); *B65D 5/029* (2013.01); *B65D 5/12* (2013.01)

(58) Field of Classification Search
CPC .. B65D 5/36; B65D 5/326–327; B65D 5/029; B65D 5/0272; B65D 5/12; B65D 5/643; B65D 5/4262; B65D 85/30
(Continued)

(56) References Cited

U.S. PATENT DOCUMENTS 5,630,543 A 5/1997 Dugan
5,921,465 A * 7/1999 Garton ..... B65D 5/326 229/117.06
(Continued)

FOREIGN PATENT DOCUMENTS

DE 20101173 U1 * 5/2001 ..... B65D 5/029
DE 202004007758 U1 * 10/2005 ..... B65D 5/32
(Continued)

*Primary Examiner* — Nathan J Newhouse
*Assistant Examiner* — Phillip D Schmidt
(74) *Attorney, Agent, or Firm* — Daniel M. Cohn; Howard M. Cohn

(57) ABSTRACT

A flattenable volume-optimized container, having a prism-shaped layout, formed of at least eight mutually connected sidewall parts, of which sidewall parts, two respectively are essentially parallel to one another and have the same sidewall length, wherein, with respect to the center point of the layout, the sidewall parts are arranged at least essentially point-symmetrically, and at least one bottom part essentially perpendicularly alignable with respect to the sidewall parts and foldable between the sidewall parts, and hinged to at least two sidewall parts. The invention includes four of the sidewall parts having a length which is greater than the length of four other sidewall parts, and two sidewall parts mutually opposite with respect to the center point each have a folding line on their side median, by which the ring can be flattened and which are situated on the outer boundary of the flattened container.

8 Claims, 6 Drawing Sheets

Figure 1:
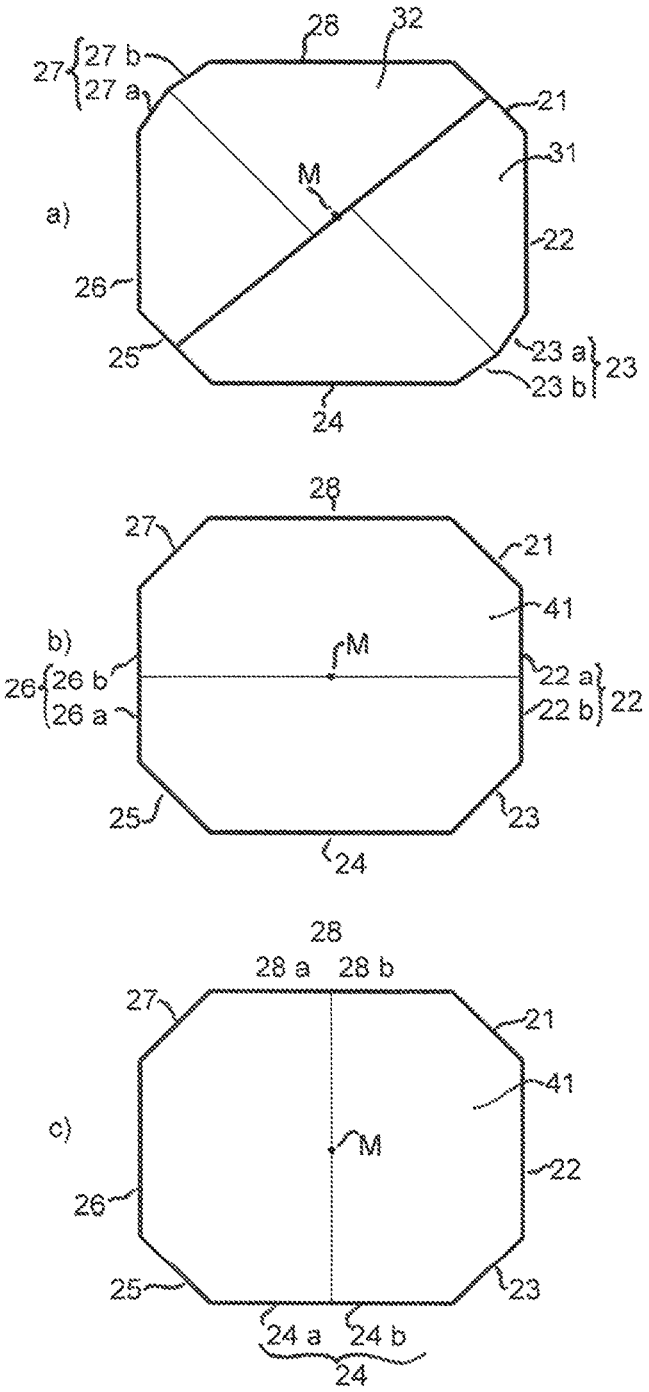

(58) Field of Classification Search
USPC ..... 229/117, 117.01, 117.05–117.6, 108, 229/108.1, 109, 122.28, 122.3, 942
See application file for complete search history.

(56) References Cited

U.S. PATENT DOCUMENTS

| | | | | |
|---|---|---|---|---|
| 6,386,437 | B1 * | 5/2002 | Larson, Jr. | B65D 5/3621 229/117.06 |
| 2010/0065620 | A1 * | 3/2010 | Smith | B65D 5/10 229/117 |
| 2016/0075466 | A1 * | 3/2016 | Wiley | B65D 5/36 229/109 |

FOREIGN PATENT DOCUMENTS

| | | | | |
|---|---|---|---|---|
| DE | 102014017999 | B3 * | 5/2016 | B65D 5/32 |
| EP | 965530 | A1 * | 12/1999 | B65D 5/36 |
| EP | 1225130 | A1 * | 7/2002 | B65D 5/029 |
| ES | 2684869 | A1 * | 10/2018 | B65D 5/02 |

* cited by examiner

FLATTENABLE VOLUME-OPTIMIZED CONTAINER

The present invention relates to a flattenable volume-optimized container, preferably made of corrugated cardboard, having a prism-shaped layout, according to the preamble of claim 1.

From European Patent Document 1 225 130 A1, an octagonal foldable container made of corrugated cardboard is known by means of which heavy and extremely heavy goods can be reliably transported. In order to be able to optimally utilize the space available, for example, on a pallet, the two sidewall parts to be arranged along the longitudinal sides of a rectangular pallet can be longer than the remaining six sidewall parts.

However, increasingly, there is the need for transporting not only very heavy goods but also lighter goods as cost-effectively as possible in such foldable or flattenable containers. For this purpose, it is imperative to be able to accommodate a volume that is as large as possible in such a container. Simultaneously, for the transport to the point of use, such a container should be foldable to a flat state in which it is as small as possible, and should be reliably and quickly unfoldable at the point of use without requiring complicated handling.

It is an object of the present invention to create a flattenable container which has a volume that is as large as possible, and, folded together to a small size, can be transported, can be unfolded without any assembly aid and can be produced in a dimensionally stable as well as machine-supported manner at reasonable cost.

According to the invention, this object can be achieved by means of a container indicated in claim 1. Advantageous further developments of the invention are the object of the subclaims.

According to the invention, a flattenable volume-optimized container, preferably made of corrugated cardboard, having a prism-shaped layout, is formed of at least eight mutually connected sidewall parts preferably formed from a single piece and connected to form a ring, of which sidewall parts, two respectively are essentially parallel to one another and have the same side length, wherein, with respect to the center point of the layout, the sidewall parts are arranged at least essentially point-symmetrically, and formed of at least one bottom part, which can be aligned at least essentially perpendicularly with respect to the sidewall parts and can be folded between the sidewall parts, and is hinged to at least two sidewall parts. The invention is characterized in that four of the sidewall parts have a length that is greater than the length of four other sidewall parts, and that two sidewall parts situated mutually opposite with respect to the center point each have a folding line on their side median, by which folding line the ring can be flattened, and which folding lines form the outer boundary of the flattened container.

As a result of the fact that four (and therefore not just two) of the at least eight sidewall parts are longer than four other sidewall parts, the container according to the invention can be designed with a greater volume relative to the same base area of a pallet. In order to nevertheless be able to flatten and then unfold such a container without any problems, one folding line respectively is provided in two sidewall parts, which are situated opposite one another with respect to the center point, on their respective side median—parallel to the folding lines between the individual sidewall parts —, which folding lines permit a flattening of the ring formed of the sidewall parts. As soon as the container according to the invention has been folded to a flat state, these two folding lines will form the outer boundary or be situated on the outer boundary.

The expression "at least essentially point-symmetrical" is to mean that an exact point symmetry of the arrangement of the sidewall parts is not important but that, for example, their respective angles with respect to the neighboring sidewall parts are designed such that the container can be flattened and unfolded again without any problem. Thus, for example, one or more sidewall parts could be designed "on one side" in a multipart or rounded fashion without a corresponding point symmetry "on the other side".

According to a first advantageous embodiment of the invention, at least two sidewall parts called long sidewall parts have a first length, and two sidewall parts called medium-sized sidewall parts may optionally have a second length, which is shorter than the first length (or exactly as large as the first length), and four short sidewall parts have a third length which is shorter than the second length, two short sidewall parts each having the folding line. A first bottom part is provided, which is hinged to a first long sidewall part and to a first medium sidewall part, and a second bottom part is provided, which is hinged to a second medium sidewall part. This embodiment is therefore characterized in that only two bottom parts are provided and that the bottom can therefore be produced with a low input of material.

An advantageous further development of the above-mentioned first embodiment is characterized in that a first bottom tab adjacent to a first short sidewall part with a folding line, and a second bottom tab adjacent to a second short sidewall part without a folding line, are hinged to the first bottom part. In addition, a first bottom tab adjacent to a second short sidewall part with a folding line and a second bottom tab adjacent to a first short sidewall part without a folding line are hinged to the second bottom part. As a result of the two bottom tabs hinged to each bottom part, the stability of the bottom is significantly increased in the unfolded state of the container.

Another advantageous further development of the above-mentioned first embodiment is characterized in that the second bottom tabs each comprise a segment which, in the course of the unfolding of the container, comes to rest against the respective first and second medium sidewall part adjacent to the respective first and second short sidewall part without a folding line and supported thereon in a sliding manner, wherein, in the course of the unfolding of the container, the segment is increasingly folded over. As a result, the corresponding segments carry out the function of an assembly aid for the bottom during the unfolding of the container and ensure that the unfolding operation can be reliably carried out without any problems.

A second advantageous embodiment of the invention is characterized in that a first bottom tab adjacent to a first short sidewall part with a folding line is hinged to the first bottom part; a first bottom tab adjacent to a second short sidewall part with a folding line is hinged to the second bottom part, and a third bottom part as well as a fourth bottom part are hinged to the first and to the second short sidewall part respectively without a folding line, which sidewall parts, in the flattened state, are arranged in the interior on the first and second short sidewall part respectively without a folding line and, in the course of the unfolding of the container, slide between the two bottom parts. The two bottom parts, which are therefore fixedly connected with the corresponding sidewall, result in an even more stable design of the container, because six of the eight sidewall parts are fixedly connected with a respective bottom part.

A third advantageous embodiment of the invention is characterized in that a third bottom part and a fourth bottom part respectively are hinged to the first and to the second short sidewall part without a folding line and, in the flattened state, are arranged in the interior on the first and second short sidewall part respectively without a folding line, and in the course of the unfolding of the container, slide between the two bottom parts, and a fifth bottom part and a sixth bottom part are hinged to the first as well as to the second short sidewall part respectively with a folding line and, are arranged in the flattened state in the interior on the first and second short sidewall part with a folding line respectively and, in the course of the unfolding of the container, are pivoted to come to rest against the two bottom parts. The four bottom parts, which are therefore fixedly connected with the corresponding sidewall, result in an even more stable design of the container, because all eight sidewall parts are fixedly connected with a respective bottom part.

According to a fourth advantageous embodiment of the invention, at least two long sidewall parts have a first length; two medium sidewall parts optionally have a second length, which is shorter than this first length, and four short sidewall parts have a third length which is shorter than the second length, respective medium sidewall parts having the folding line, and a first bottom part is provided which is hinged to the two long sidewall parts. Since a single bottom part is sufficient for the fourth embodiment, the latter can be produced in a simple manner and with a low input of material.

A fifth embodiment is characterized in that a second bottom part is provided, which is hinged to the short sidewall parts adjacent to the one sidewall part with a folding line, and a third bottom part is provided, which is hinged to the short sidewall parts adjacent to the other sidewall part with a folding line. Because two further bottom parts are provided, which are each hinged to two sidewall parts, the stability of this embodiment of the container can be increased.

A sixth embodiment is characterized in that one bottom tab respectively adjacent to the respective sidewall part with a folding line is hinged to the second and to the third bottom part in such a manner that, in the course of the unfolding of the container, it is swivelled such that, in the unfolded state of the container, it is arranged on the sidewall part with the folding line. As a result, the container according to this embodiment can very easily and reliably be unfolded, and the two additional bottom tabs, which, in the unfolded state of the container, rest against the corresponding sidewall parts with a folding line, will additionally stabilize the container.

According to a variation of the above-mentioned embodiments, the two sidewall parts mutually opposite with respect to the center point are divided by the respective folding line on their side median into two sidewall segments respectively, which are angled with respect to one another. The angling of the two sidewall parts at the respective folding lines can—particularly in the case of a corresponding design of the relevant bottom parts—contribute to a further stiffening and thus an associated stabilization of the unfolded container.

When the container according to the invention is flattened, it can generally be unfolded by a simple pressing-together of the two opposite edges on which the (additional) folding lines are situated, without any further handling. It is understood that, for this purpose, the respective bottom parts should have the corresponding construction and be hinged to the corresponding sidewall parts.

Further advantages, characteristics and special features of the invention are indicated in the following description of advantageous but not limiting embodiments of the invention by means of the schematic and not true-to-scale drawings.

Figure 2:
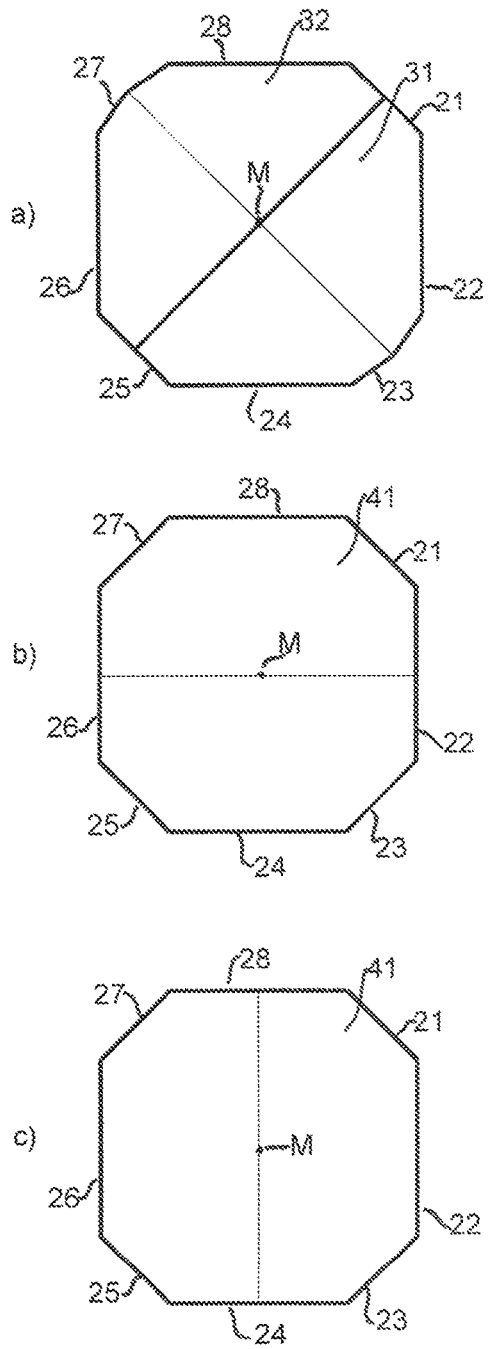
Figure 3:
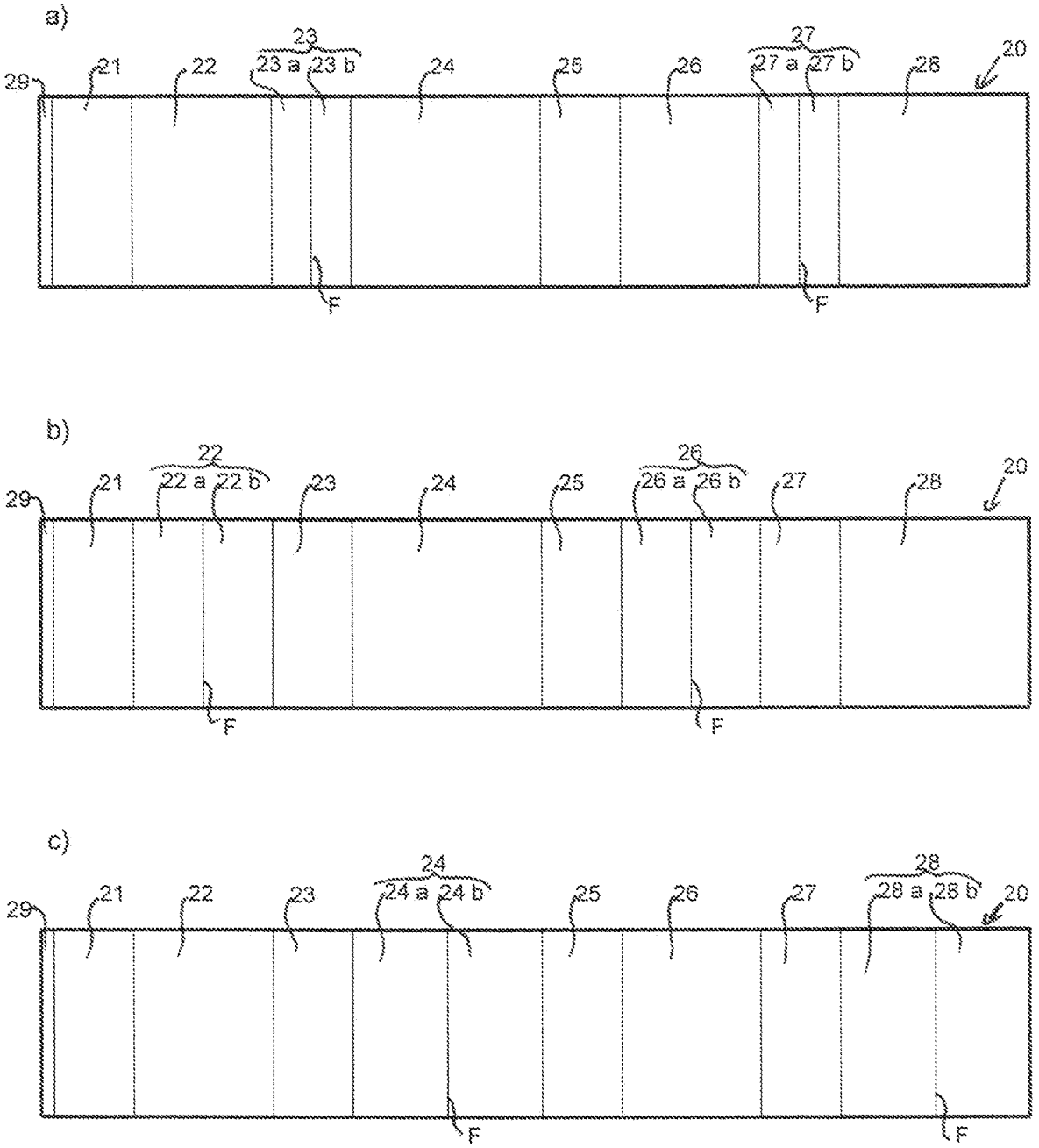
Figure 4:
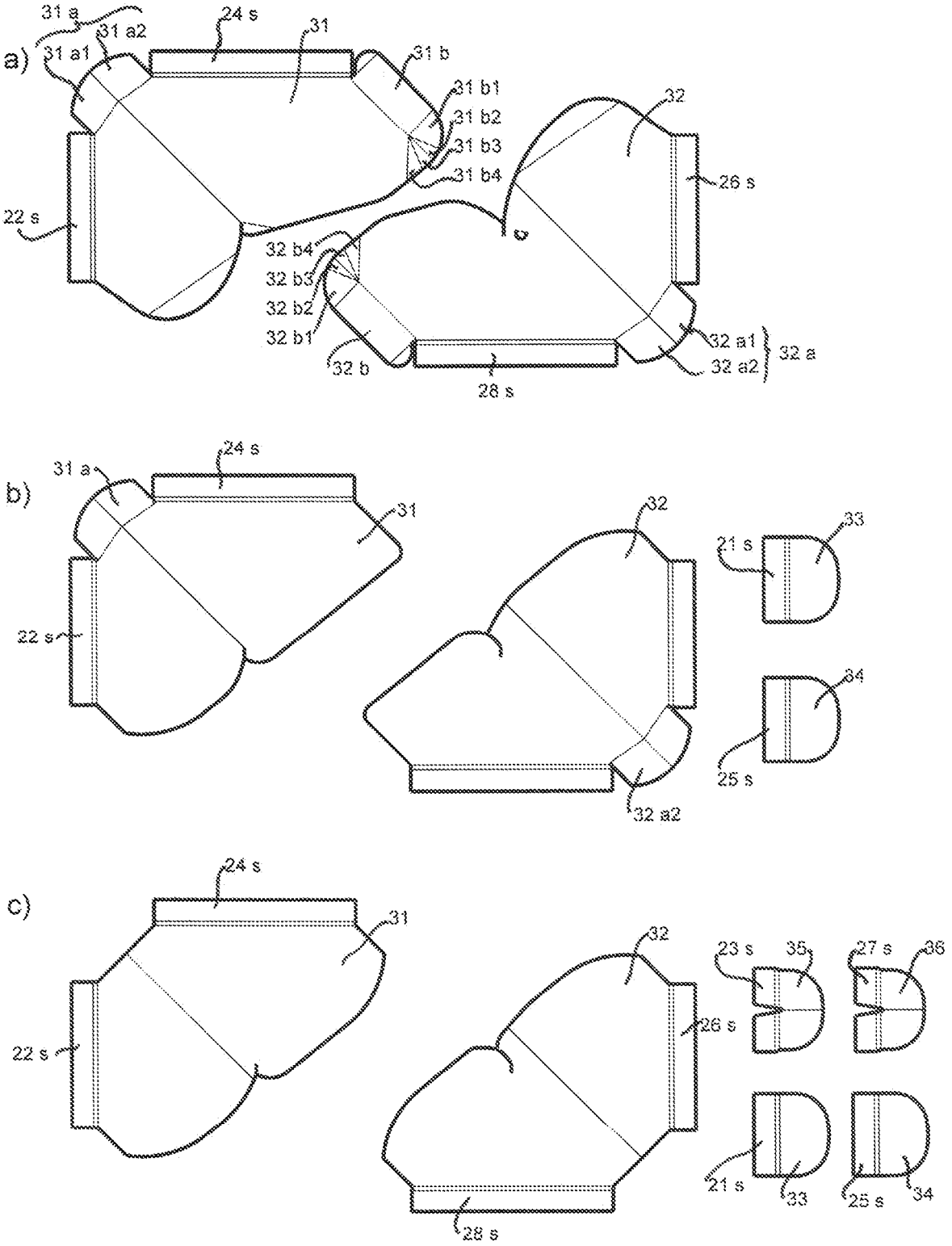
Figure 5:
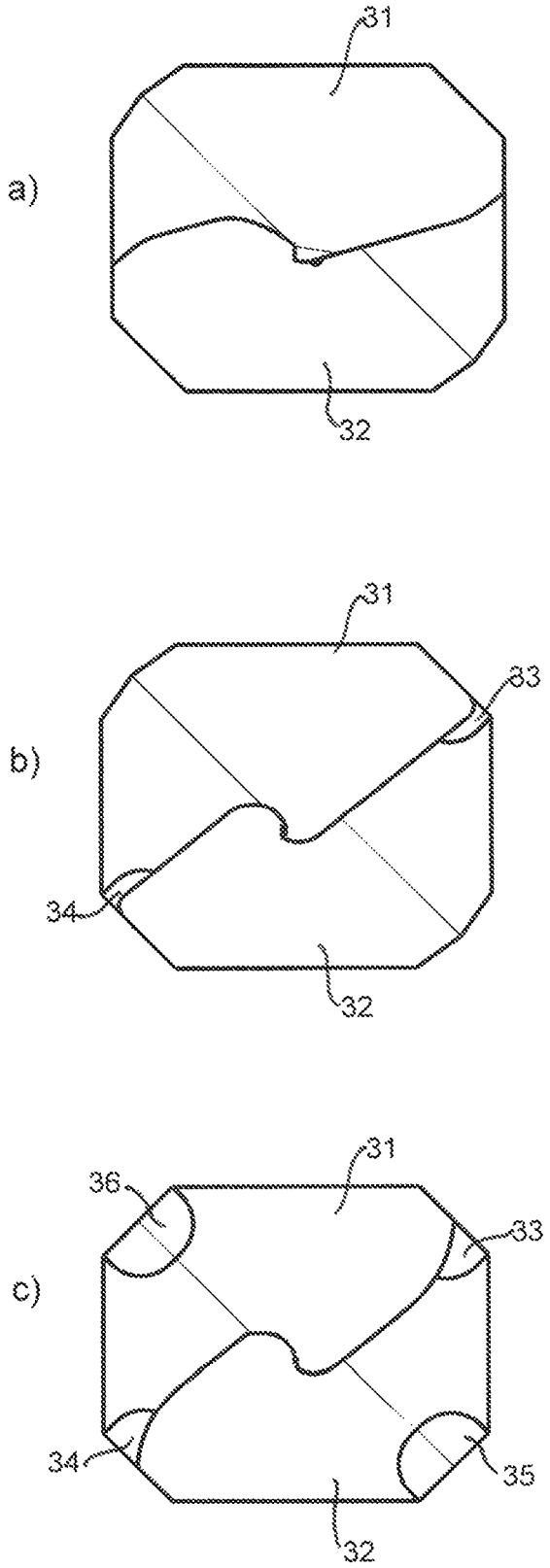
Figure 6:
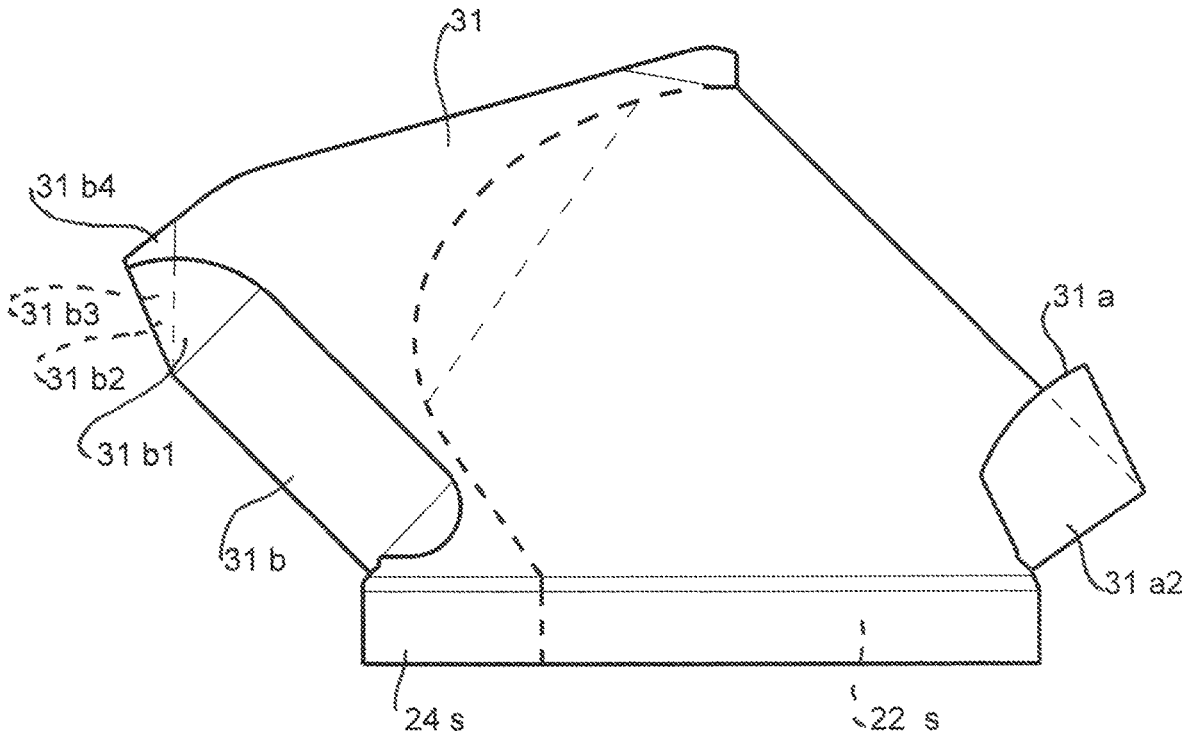
Figure 7:
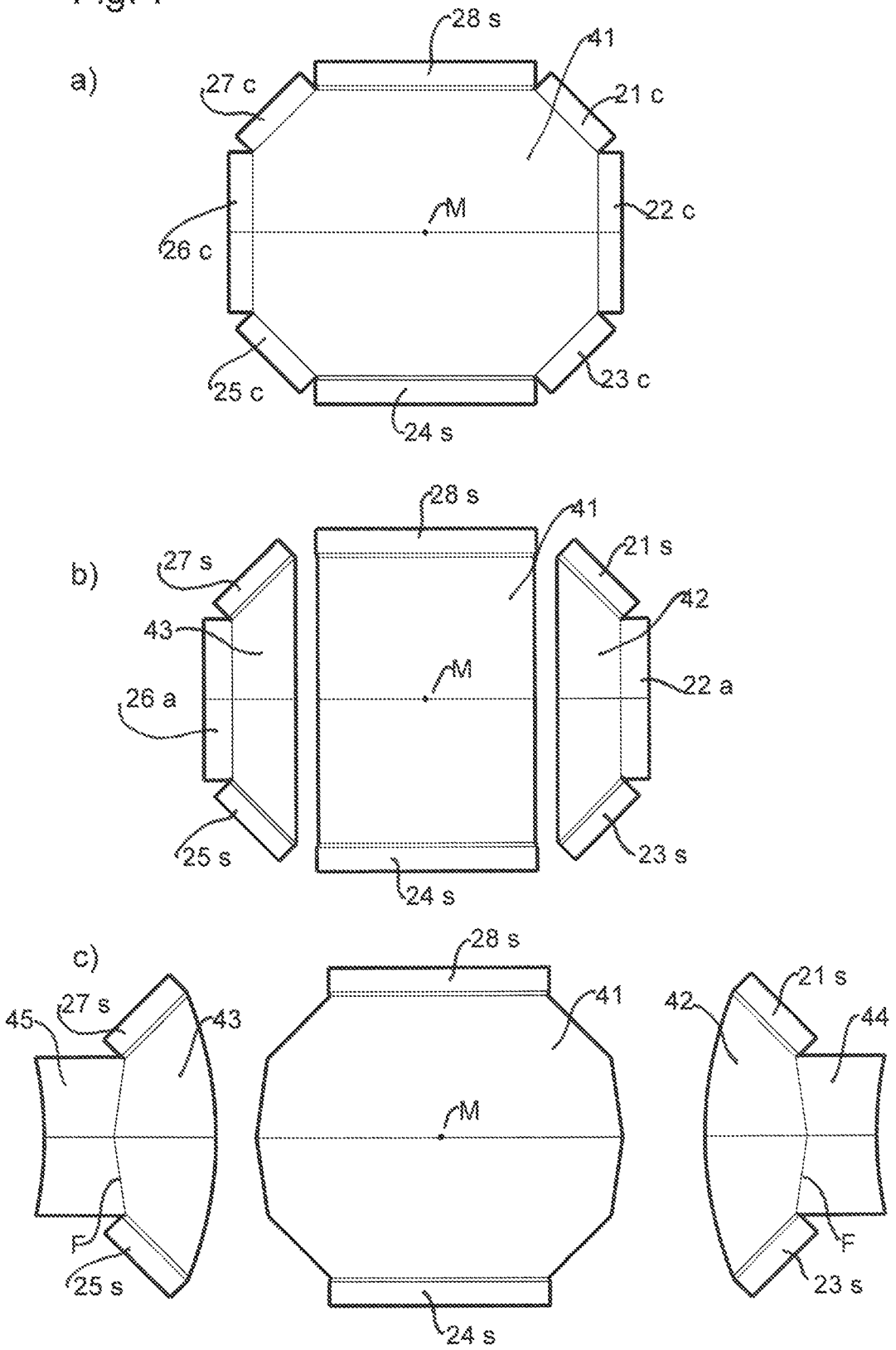

FIGS. 1*a*) to 1*c*) are schematic top views of unfolded containers according to the invention having an octagonal layout, wherein two long sidewall parts, two medium-long sidewall parts and four short sidewall parts respectively are present;

FIGS. 2*a*) to 2*c*) are schematic top views of unfolded containers according to the invention having an octagonal layout, wherein four identical long sidewall parts and four short sidewall parts are present;

FIGS. 3*a*) to 3*c*) are schematic side views of respective unwound rings of sidewall parts corresponding to the representations in FIGS. 1*a*) to 1*c*);

FIGS. 4*a*) to 4*c*) are exploded schematic top views of bottom parts of a first, second and third embodiment respectively of a container according to the invention having a layout corresponding to FIG. 1*a*);

FIGS. 5*a*) to 5*c*) are schematic top views of the first, second and third embodiment respectively of the container according to the invention;

FIG. 6 is a top view of a folded first and second bottom part respectively according to the first embodiment; and FIGS. 7*a*) to 7*c* are schematic top views of different variants of a fourth embodiment.

For facilitating the further explanation, the direction and orientation information here relate, for example, to a surface that is assumed to be horizontal and on which the unfolded container is placed. In the further course of the description, the term "horizontal" therefore describes the plane or direction parallel to this surface, while the term "vertical" describes a plane or direction vertical to this surface. Terms such as "right and left" relate to a vertical view onto the drawing plane.

FIGS. 1*a*) to 1*c*) are schematic top views of containers unfolded according to the invention, which have an octagonal layout. Two sidewall parts 24, 28 respectively are longer than two other medium-sized sidewall parts 22, 26 respectively, and these four sidewall parts are longer than the remaining four sidewall parts 21, 23, 25 and 27. FIG. 2*a*) to FIG. 2*c*) also are schematic top views of unfolded containers with an octagonal layout. Four sidewall parts 22, 24, 26 and 28 respectively are longer than the remaining four sidewall parts 21, 23, 25 and 27. FIGS. 3*a*) to 3*c*) are schematic side views of respective unwound rings of sidewall parts 21 to 28 corresponding to the presentations in FIGS. 1*a*) to 1*c*). A small sidewall part 29 attached to the sidewall part 21 is used for the mechanical connection with sidewall part 28, in order to form a ring 20 from the sidewall parts 21 to 28.

The bottom parts 31 and 32 and the bottom part 41 respectively are—delimited by bold continuous lines, which partially coincide with the boundaries of the sidewall parts—shown such that, in each case, they mutually adjoin in a seamless manner. However, the bottom parts may also overlap or become narrower from one sidewall segment to the next or taper only between the sidewall parts, if a tightness of the bottom is not required and a corresponding reduction of the stability of the container is acceptable. The grooving or folding line, which permits the folding of the bottom parts, is, in each case, defined by a thin continuous line. Folding lines of sidewall parts are, in each case, also indicated by a thin continuous line. The center or the center point of the layout of the container is defined by the reference symbol M. In the subsequent FIGS. 4, 6 and 7, which will be described in detail in the following, folding lines are indicated by thin continuous double lines, along which folding lines corresponding tabs of sidewall parts or bottom parts can be glued to corresponding counterparts. These conventional drawing aspects apply to all figures—unless explicitly indicated otherwise—.

As illustrated, in the case of the container according to FIG. 1*a*) and FIG. 3*a*), two short sidewall parts 23 and 27, which are arranged point-symmetrically with respect to the center point M, each have a vertically extending folding line F on their side median, which folding line F is parallel to the other folding lines, that are not described in detail, between the individual sidewall parts. In this case, the folding lines F divide the sidewall parts 23 and 27 into respective sidewall part segments 23*a* and 23*b*, and 27*a* and 27*b* respectively. According to the example illustrated in FIG. 1*a*), the sidewall part segments 23*a* and 23*b*, and 27*a* and 27*b* respectively are arranged at an angle to one another but they can also each be arranged in a plane. In any case, in order to simplify the representation, it is assumed that two respectively associated sidewall part segments form a single sidewall part, and even when the arrangement is at an angle, should not be considered to be two sidewall parts, which could have the result that the container illustrated in FIG. 1*a*) could be considered to be a decagonal layout.

Corresponding to the two folding lines F in the sidewall parts 23 and 27, the two bottom parts 31 and 32 have folding lines by means of which the container can be flattened.

In the case of the container according to FIG. 1*b*) and FIG. 3*b*), two medium-long sidewall parts 22 and 26 each have a vertically extending folding line F, which is parallel to the remaining folding lines not described in detail, between the individual sidewall parts. In this case, the folding lines divide the sidewall parts 22 and 26 into respective sidewall part segments 22*a* and 22*b*, and 26*a* and 26*b*. Corresponding to the two folding lines F in the sidewall parts 22 and 26, the bottom part 41 has a corresponding folding line, by means of which the container can be flattened.

In the case of the container according to FIG. 1*c*) and FIG. 3*c*), two long sidewall parts 24 and 28 each have a vertically extending folding line F, which is parallel to the remaining folding lines not described in detail, between the individual sidewall parts. In this case, the folding lines F divide the sidewall parts 24 and 28 into respective sidewall part segments 24*a* and 24*b*, and 28*a* and 28*b*. Corresponding to the two folding lines F in the sidewall parts, 24 and 28, the bottom part 41 has a folding line by means of which the container can be flattened.

Such containers can optimally utilize rectangular-shaped bearing surfaces, such as pallets, because they have a larger volume with respect to the containers known from the state of the art.

The above-mentioned statements analogously apply to the containers according to FIGS. 2*a*) to 2*c*), wherein the "long" and "medium-long" sidewall parts have the same length. Such containers can optimally utilize square-shaped bearing surfaces, such as pallets, because they have a larger volume with respect to the containers known from the state of the art.

In the following, parts which have the same reference number, are parts having an identical or an equivalent function.

FIGS. 4*a*) to 4*c*) and FIGS. 5*a*) to 5*c*) illustrate first to third embodiments of the present invention, wherein FIGS. 4*a*) to 4*c*) each show layouts of bottom parts, whereas FIG. 5*a*) to FIG. 5*c*) each are top views of an unfolded container.

FIG. 4*a*) shows layouts of two bottom parts 31 and 32 of a first embodiment of the container according to the invention. A first fastening tab 22*s* and a second fastening tab 24*s* are pivotably provided—preferably in one piece—at the first bottom part, by means of which fastening tabs, this first bottom part 31 is fastened preferably on the outside to the sidewall parts 22 and 24 respectively (indicated in the drawing by a double grooving). In addition, a first bottom tab 31*a* is pivotably mounted on the first bottom part 21 and has a folding line F and, in the folded state of the container, comes to rest on the inside on the sidewall part 23 provided with a folding line F. The folding line F in the first bottom tab 31*a* is continued on the first bottom part 31, so that the two folding lines are situated on a single straight line. In addition, a second bottom tab 31*b* is pivotably mounted on the first bottom part 31 and, in the folded state of the container, comes to rest on the inside on the sidewall part 21 constructed without a folding line. The second bottom tab 31*b* comprises mutually adjoining bottom tab segments 31*b*1, 31*b*2, 31*b*3, 31*b*4, which each have folding lines between one another, a folding line also being situated between the bottom tab segment 31*b*1 and the second bottom tab 31*b*. In the used state, the two bottom tab segments 31*b*2 and 31*b*3 are in this case mutually connected, particularly glued together or clamped together, with the undersides illustrated in FIG. 4*a*. As a result, the second bottom tab 31*b* illustrated in FIG. 4*a*) rests with its top side on the top side of the first bottom part 31 and is therefore pivoted by 180° with respect to the illustration in FIG. 4*a*). Such a folded-together first bottom part 31, which furthermore is also folded together on the folding F, is illustrated as an example in FIG. 6.

During the unfolding of the container according to the invention, as a result of the design of the bottom tab 31*b* according to the invention, the bottom tab segment 31*b*2 rests with the bottom tab segment 31*b*3 fastened thereto first in the interior on the short sidewall part 21; then in the further course of the unfolding, comes to rest on the medium sidewall part 22, slides in the course of the unfolding along the sidewall part 22 and has the effect that the first bottom tab 31*b* comes to rest on the short sidewall part 21, and slides downward thereon, until the container is in the final unfolded state. The bottom tab segments 31*b*1, 31*b*2, 31*b*3, 31*b*4 therefore have the function of an assembly aid.

At least with respect to a first bottom tab 32*a* and a second bottom tab 32*b*, the second bottom part 32 has a point-symmetrical construction with respect to the first bottom part 31. As a result, the first bottom tab 32*a* comes to rest on the short sidewall part 27 with a folding line F, and the second bottom tab 32*b* is adjacent to the short sidewall part 25 and has bottom tab segments 32*b*1, 32*b*2, 32*b*3, 32*b*4, which slide along the medium sidewall part 26 until the container is completely unfolded.

FIG. 4*b*) illustrates layouts of four bottom parts 31 to 34 of a second embodiment of the container according to the invention. As in the case of the first embodiment, a first fastening tab 22*s* and a second fastening tab 24*s* are pivotably provided on the first bottom part 31—also preferably in one piece —, and, in addition, a first bottom tab 31*a* is pivotably mounted on the first bottom part 31, which bottom tab 31*a* has a folding line F, and, in the folded state of the container, comes to rest in the interior on the sidewall part 23 provided with a folding line F. The folding line F in the first bottom tab 31*a* continues on the first bottom part 21, so that the two folding lines are situated on a single straight line. The second bottom part 32 has a corresponding construction. The second embodiment differs from the first embodiment in that, instead of the second bottom tabs, the two bottom parts 33 and 34 are provided. The bottom part 33 is provided with a hinged fastening tab 21*s*, and the bottom part 34 is provided with a hinged fastening tab 25*s*. By means of these fastening tabs 21*s* and 25*s*, the bottom parts 33 and 34 are preferably fastened on the outside to the sidewall parts 21 and 25 respectively.

FIG. 4*c*) illustrates layouts of six bottom parts 31 to 36 of a third embodiment of the container according to the invention. The two bottom parts 33 and 34 are constructed as in the second embodiment, and the third embodiment differs from the second embodiment in that, instead of the first bottom tabs 31*a* and 32*a* attached to the two bottom parts 31 and 32, separate bottom parts 35 and 36 are provided. The bottom part 35 is provided with a hinged fastening tab 23*s*, and the bottom part 36 is equipped with a hinged fastening tab 27*s*. By means of these fastening tabs 23*s* and 27*s*, the bottom parts 35 and 36 respectively are preferably fastened on the outside to the sidewall parts 23 to 27 which have a folding groove F. As illustrated in FIG. 4*c*), the fastening tabs 23*s* and 27*s* are constructed to have a slot in their center, which slot comes to be located over the folding groove F of the corresponding sidewall parts.

According to the third embodiment illustrated in FIG. 5*c*), in the unfolded state, the fifth bottom part 35 rests completely on the first bottom part 31, and the sixth bottom part 36 rests completely on the second bottom part 32. However, it is also conceivable that, by providing corresponding slots in the first and second bottom part 31, 32, it becomes possible that one section of each bottom part 35 and 36 is situated above and the other section of these bottom parts 35 and 36 is situated below the first bottom part 31 or the bottom part 32 respectively and thereby results in an almost fan-like arrangement of the six bottom parts 31 to 36.

It should be noted that the bottom parts illustrated above may be designed to mutually overlap, which is generally known. In addition, they may have suitable slots and further designs which permit an interlocking in the unfolded state—as well as, if applicable, an unlocking.

For a better illustration, FIG. 6 shows a bottom part 31 according to a first embodiment that is folded together and has a first bottom tab 31*a* hinged to it as well as a second bottom tab 31*b* hinged thereto. Of the bottom tab segments 31*b*1, 31*b*2, 31*b*3, 31*b*4 of the second bottom tab 31*b*, in this case, the two bottom tab segments 31*b*2 and 31*b*3 are already fixedly connected with one another. Here, the four bottom tab segments 31*b*1, 31*b*2, 31*b*3, 31*b*4 are situated above one another, which is outlined by broken lines from the reference numbers to the respective invisible bottom tab segments 31*b*2 and 31*b*3, wherein the part of the bottom tab segment 31*b*1 situated to the left of the folding line covers the bottom tab segment 31*b*2. As an alternative, it is conceivable that, in the used state, the two bottom tab segments 31*b*2 and 31*b*3 are mutually connected with the top sides illustrated in FIG. 4*a*), in particular, are glued together or clamped together. In this case, the two bottom tab segments 31*b*2 and 31*b*3 as well as the two bottom tab segments 31*b*1 and 31*b*4 are situated above one another, wherein the folding line extends between the two bottom tab segments 31*b*2 and 31*b*3 as an extension of the folding line between the bottom tab 31*b* and the bottom part 32.

FIGS. 7*a*) to 7*c*) illustrate layouts of bottom parts of the fourth to sixth embodiments of the present invention.

According to an illustration of the fourth embodiment in FIG. 7*a*), only a single bottom part 41 is provided which has a folding line F, and which is fastened to the sidewall parts 24 and 28 respectively by means of two hinged fastening tabs 24*s* and 28*s*. The bottom part 41 essentially covers the entire base area of the container. In the case of this fourth embodiment, the medium sidewall parts 22 and 26 have the folding line F. Six bottom tabs 21*a*, 22*a*, 23*a*, 25*a*, 26*a* and 27*a* are hinged to the bottom part 41 and rest on the interior sides of the sidewall parts 21, 22, 23, 26 and 27 respectively, but are not fixedly connected to them. This fourth embodiment is easy to produce because only a single bottom part has to be produced and has to be fastened on only two sidewall parts.

According to the illustration of the fifth embodiment in FIG. 7*b*), a first bottom part 41 is provided, which is fastened to the sidewall parts 24 and 28 respectively by means of two hinged fastening tabs 24*s* and 28*s*. The bottom part 41 essentially covers only the space between the two sidewall parts 24 and 28. In addition, a second bottom part 42 and a third bottom part 43 are provided, which cover the remaining base area of the container. However, the bottom parts 41 to 43 may also be designed to be larger, so that they mutually overlap, similarly to the embodiments illustrated in FIGS. 4*a*) to 4*c*). The second bottom part 42 has two hinged fastening tabs 21*s* and 23*s*, by means of which it can be fastened to the sidewall parts 21 and 23 respectively. In addition, the second bottom part 42 has a second bottom tab 22*a*, which rests on the interior side of the sidewall part 22, but is not fixedly connected with the latter. Similarly, the third bottom part 43 has two hinged fastening tabs 25*s* and 27*s*, by means of which it can be fastened to the sidewall parts 25 and 27 respectively. In addition, the third bottom part 43 has a third bottom tab 26*a*, which rests on the interior side of the sidewall part 26, but is not fixedly connected with the latter. The two bottom parts 42 and 43 have the folding line F.

A particularly advantageous sixth embodiment is illustrated in FIG. 7*c*). The sixth embodiment differs from the fifth embodiment, on the one hand, in that, as in the fourth embodiment, the first bottom part 41 essentially covers the entire base area; one bottom tab 44 and 45 respectively is hinged to the two bottom parts 42 and 43, and the bottom parts 41 to 43 overlap one another. On the other hand, the sixth embodiment is characterized in that the sidewall parts 22 and 26 are divided by the respective folding line F into two sidewall part segments 22*a*, 22*b* and 26*a*, 26*b* respectively, which are each arranged at an angle relative to one another, so that the unfolded container is pulled slightly toward the outside at the two folding lines. Correspondingly, the folding line F between the bottom part 42 and the bottom tab 44 as well as between the bottom part 43 and the bottom tab 45 is also at an angle. In the case of an unfolded container according to the sixth embodiment, the two bottom parts 42 and 43 are situated below the bottom part 41. In the case of the folded-together container according to this sixth embodiment, the first bottom part 41 therefore comes to be situated between the second bottom part 42 and the bottom tab 44 as well as between the third bottom part 43 and the bottom tab 45. As a result of this arrangement, the two bottom tabs 44 and 45 are reliably and fixedly pressed against the two sidewall parts 22 and 26 respectively by the unfolding first bottom part 41 as well as by the respective angled folding line F. The resulting container has high dimensional stability.

In the preceding description, it was assumed that the container is produced of corrugated cardboard. However, it may also be made of different materials, such as paper or a plastic material.

It should be noted that, because of the essentially given point symmetry of the sidewall parts with respect to the center point, in each case, only an even number of sidewall parts are present. Correspondingly, the present invention also includes containers with ten, twelve or even more sidewall parts. However, as mentioned above, the point symmetry may also be punctually cancelled in that, for example, a single sidewall part is divided in two angled sections, has a rounded construction or the like.

It should be noted that the characteristics of the invention described with reference to individual embodiments, such as bottom parts and bottom tabs, sidewall parts, sidewall part segments and fastening tabs as well as additional folding lines, may also be present in the case of other embodiments, unless otherwise indicated or automatically prohibited for technical reasons. With respect to such characteristics of individual embodiments described in combination, in addition, not necessarily all characteristics always have to be implemented in a respective embodiment.

LIST OF REFERENCE NUMBERS

20 Ring
21-28 Sidewall part
21*c*-27*c* Bottom tab
21*s*-28*s* Fastening tab
22*a*-27*a* Sidewall part segment
22*b*-27*b* Sidewall part segment
29 Small sidewall part
31-36 Bottom part
31*a*,32*a* First bottom tab
31*b*,32*b* Second bottom tab
31*b*1-31*b*4 Bottom tab segment
32*b*1-32*b*4 Bottom tab segment
41-43 Bottom part
44-45 Bottom tab
F Folding line
M Center point

The invention claimed is:

1. Flattenable volume-optimized container, made of corrugated cardboard, having a prism-shaped layout, formed of at least eight mutually connected sidewall parts, formed from a single piece and connected to form a ring, of which sidewall parts, two respectively are essentially parallel to one another and have the same sidewall length, wherein, with respect to the center point of the layout, the sidewall parts are arranged at least essentially point-symmetrically; and at least one bottom part essentially perpendicularly alignable with respect to the sidewall parts and foldable between the sidewall parts, and hinged to at least two sidewall parts; wherein four of the sidewall parts have a length which is greater than the length of four other sidewall parts; and two sidewall parts mutually opposite with respect to the center point each have a folding line on their side median, by which the ring can be flattened and which are situated on the outer boundary of the flattened container; at least two long sidewall parts have a first length, two medium sidewall parts have a second length, which is shorter than the first length, and four short sidewall parts have a third length, which is shorter than the second length, two short sidewall parts each having the folding line; and a first bottom part hinged to a first long sidewall part and to a first medium sidewall part, and a second bottom part hinged to a second long sidewall part and to a second medium sidewall part are provided; wherein a first bottom tab, which is adjacent to a first short sidewall part with a folding line, and a second bottom tab, which is adjacent to a second short sidewall part without a folding line, are hinged to the first bottom part; and a first bottom tab, which is adjacent to a second short sidewall part with a folding line, and a second bottom tab, which is adjacent to a first short sidewall part without a folding line are hinged to the second bottom part.

2. Container according to claim 1, wherein the second bottom tabs each comprise a bottom tab segment which, in the course of the unfolding of the container, comes to rest on the first and second medium sidewall part respectively, which is adjacent to the first and second short sidewall part respectively without a folding line, and supports itself thereon in a sliding manner, whereby, in the course of the unfolding of the container, it is increasingly bent.

3. Container according to claim 2, wherein a third bottom part as well as a fourth bottom part are hinged to the first and second short sidewall part respectively without a folding line, which, in the flattened state, are arranged in the interior on the first and second short sidewall part respectively without a folding line and, in the course of the unfolding of the container, slide between the third and fourth bottom parts.

4. Container according to claim 3, wherein a fifth bottom part and a sixth bottom part respectively are hinged to the first and to the second short sidewall part with the folding line and, in the flattened state, are arranged in the interior on the first and second short sidewall part respectively with a folding line and in the course of the unfolding of the container are pivoted for resting on the two bottom parts.

5. Flattenable volume-optimized container, made of corrugated cardboard, having a prism-shaped layout, formed of at least eight mutually connected sidewall parts, formed from a single piece and connected to form a ring, of which sidewall parts, two respectively are essentially parallel to one another and have the same sidewall length, wherein, with respect to the center point of the layout, the sidewall parts are arranged at least essentially point-symmetrically; and at least one bottom part essentially perpendicularly alignable with respect to the sidewall parts and foldable between the sidewall parts (21-28), and hinged to at least two sidewall parts;

wherein four of the sidewall parts have a length which is greater than the length of four other sidewall parts; and two sidewall parts mutually opposite with respect to the center point each have a folding line on their side median, by which the ring can be flattened and which are situated on the outer boundary of the flattened container;

wherein at least two long sidewall parts have a first length, two medium sidewall parts have a second length, which is shorter than the first length, and four short sidewall parts have a third length, which is shorter than the second length, the medium sidewall parts each having the folding line; and a first bottom part is provided, which is hinged to the two long sidewall parts; and wherein a second bottom part is provided, which is hinged to the short sidewall parts adjacent to one sidewall part having the folding line, and a third bottom part is provided, which is hinged to the short sidewall parts adjacent to the other sidewall part having the folding line; and the second bottom part and the third bottom part are essentially perpendicularly alignable with respect to the sidewall parts and foldable between the sidewall parts.

6. Container according to claim 5, wherein one bottom tab respectively adjacent to the respective sidewall part with a folding line is hinged to the second and to the third bottom part such, that, in the course of the unfolding of the container, it is pivoted in such a manner that, in the unfolded state of the container, it is arranged on the sidewall part respectively with the folding line;

the respective bottom tabs are hinged such that, in the course of the unfolding of the container, they are pivoted in such a manner that, in the unfolded state of the container, they are pressed, by the bottom part, against the respective sidewall part with the folding line.

7. Container according to claim 6, wherein the two sidewall parts mutually opposite with respect to the center point, as a result of the respective folding line, on their side median, are each divided into two sidewall part segments, which are angled relative to one another.

8. Container according to claim 5, wherein at least two long sidewall parts have a first length, two medium sidewall parts have a second length, which is shorter than the first length, and four short sidewall parts have a third length, which is shorter than the second length, two short sidewall parts each having the folding line; and a first bottom part hinged to a first long sidewall part and to a first medium sidewall part, and a second bottom part hinged to a second long sidewall part and to a second medium sidewall part are provided.

* * * * *